US007261638B2

(12) United States Patent
Davis et al.

(10) Patent No.: US 7,261,638 B2
(45) Date of Patent: Aug. 28, 2007

(54) BOWLING PRACTICE DEVICE

(76) Inventors: Randy R. Davis, 1683 Dunham Cir., Thousand Oaks, CA (US) 91360; Richard Shum, P.O. Box 535, Sheung Shui Post Office, Sheung Shui, N.T. (HK)

( * ) Notice: Subject to any disclaimer, the term of this patent is extended or adjusted under 35 U.S.C. 154(b) by 0 days.

(21) Appl. No.: 11/136,755

(22) Filed: May 24, 2005

(65) Prior Publication Data

US 2006/0270482 A1 Nov. 30, 2006

(51) Int. Cl.
*A63D 5/00* (2006.01)

(52) U.S. Cl. ..... 473/55; 473/125; 473/596

(58) Field of Classification Search ..... 473/55, 473/59, 125, 588, 589, 595, 596, 613; 446/46, 446/63, 255; 273/344, 346
See application file for complete search history.

(56) References Cited

U.S. PATENT DOCUMENTS 2,683,603 A * 7/1954 Gackenbach ..... 473/613
3,884,466 A * 5/1975 MacDonald et al. ..... 473/613
4,003,574 A * 1/1977 MacDonald et al. ..... 473/613
4,955,620 A * 9/1990 Reinke ..... 473/613
5,123,645 A * 6/1992 MacDonald et al. ..... 473/594
5,199,708 A * 4/1993 Lucas ..... 273/126 R
5,269,514 A * 12/1993 Adler et al. ..... 473/596
5,458,329 A * 10/1995 Bushman et al. ..... 473/613
5,460,368 A * 10/1995 Pearson ..... 473/597
6,045,469 A * 4/2000 Gleason et al. ..... 473/613
6,220,918 B1 * 4/2001 Laronge ..... 446/63

* cited by examiner

*Primary Examiner*—William M. Pierce
(74) *Attorney, Agent, or Firm*—Elliott N. Kramsky

(57) ABSTRACT

A bowling practice device for regularizing and perfecting bowling technique. An aerodynamically designed hollow body includes an outer wall and a cylindrical inner wall. The opposed ends of the outer wall taper to meet the cylindrical inner wall. The outer wall preferably comprises a plurality of foam panels, one of which includes at least two finger holes suitable for personalization to the hand of the bowler.

18 Claims, 4 Drawing Sheets

BOWLING PRACTICE DEVICE

BACKGROUND

1. Field of the Invention

The present invention relates to the sport of bowling. More particularly, this invention pertains to a practice assistance device for enabling a bowler to regularize, and thereby enhance the consistency of his arm swing.

2. Description of the Prior Art

The sport of bowling basically requires a single piece of player equipment, namely a spherical ball that is conventionally of rigid material such as polyurethane, hard rubber, even wood. It includes finger holes, preferably suited to the size and style of the bowler, by which the ball is grasped prior to release at the end of a stroke or swing of the bowler's arm.

While neither the bowler's basic equipment nor the object of the sport is, at first glance, particularly complicated, many factors enter into a bowler's awareness as he seeks to "perfect" his game. The skilled bowler will take into account, for example, his location and launch point in relation to the degree of oiling of the lane. Various adjustments reflect many factors, including, for example, the positioning of the pins that remain standing, the thickness and contour of the oil that protects the wooden lane, etc.

Adjustments (w.r.t. launch point, stance, etc.) made for varying lane conditions and the like are most effective when the bowler is able to make such adjustments based upon a predictable stroke of the bowler's arm. Otherwise, adjustments to stance, position and the like are made "in the dark", reflect guesswork and have no particular reliability.

The bowler's stroke represents a composite motion that includes addressing the ball, and striding coordinated with backstroke and follow-through arm swings. The reduction of this relatively-complex sequence into a reliable predictable sequence of motions relies upon repetition. By coupling such repetition with analysis, one can multiply the benefits of repetitive practice of the bowler's stroke.

A number of factors complicate the ability of a bowler to engage in the type of repetition that would result in the grooving of his stroke. The most obvious type of practice requires the bowler to spend many hours by himself at the bowling alley, observing the action of his ball as he plays many practice rounds. In addition to the impracticality of such extensive practice, requiring absence from the home, for the average non-professional bowler, the feedback that he or she receives from such practice is complicated by factors, such as oiling of the boards of the alley, that prevent isolation of the action of the ball to the bowler's stroke. Furthermore, excessive practice with a bowling ball may result in arm strain.

SUMMARY OF THE INVENTION

The present invention addresses the foregoing and other shortcomings of the prior art by providing a bowling practice device for regularizing the stroke a bowler. Such device includes a generally-cylindrical, hollow body comprising an outer wall and a cylindrical inner wall. First and second finger holes are provided in the outer wall of the body for receiving a first and a second finger insert. The opposed ends of the outer wall taper inwardly to meet the cylindrical inner wall.

The preceding and other features of this invention will become further apparent from the detailed description that follows. Such description is accompanied by a set of drawing figures. Numerals of the drawing figures, corresponding to those of the written description, point to the features of the invention with like numerals referring to like features throughout both the written description and the drawing figures.

BRIEF DESCRIPTION OF THE DRAWING FIGURES

DETAILED DESCRIPTION OF THE PREFERRED EMBODIMENT

Figure 1A:
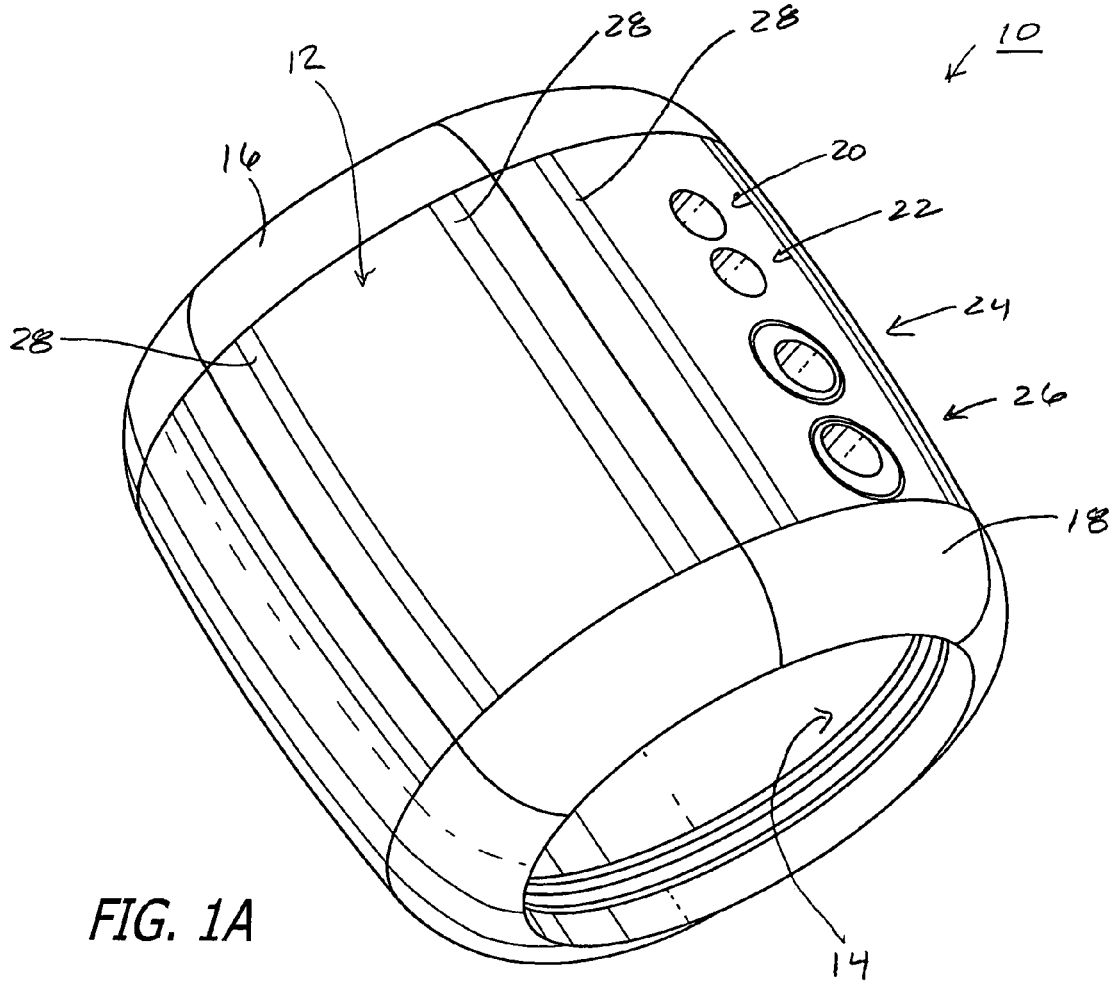
FIGS. 1A and 1B are completed and partially-exploded perspective views respectively of the bowling practice device of the invention.
Figure 1B:
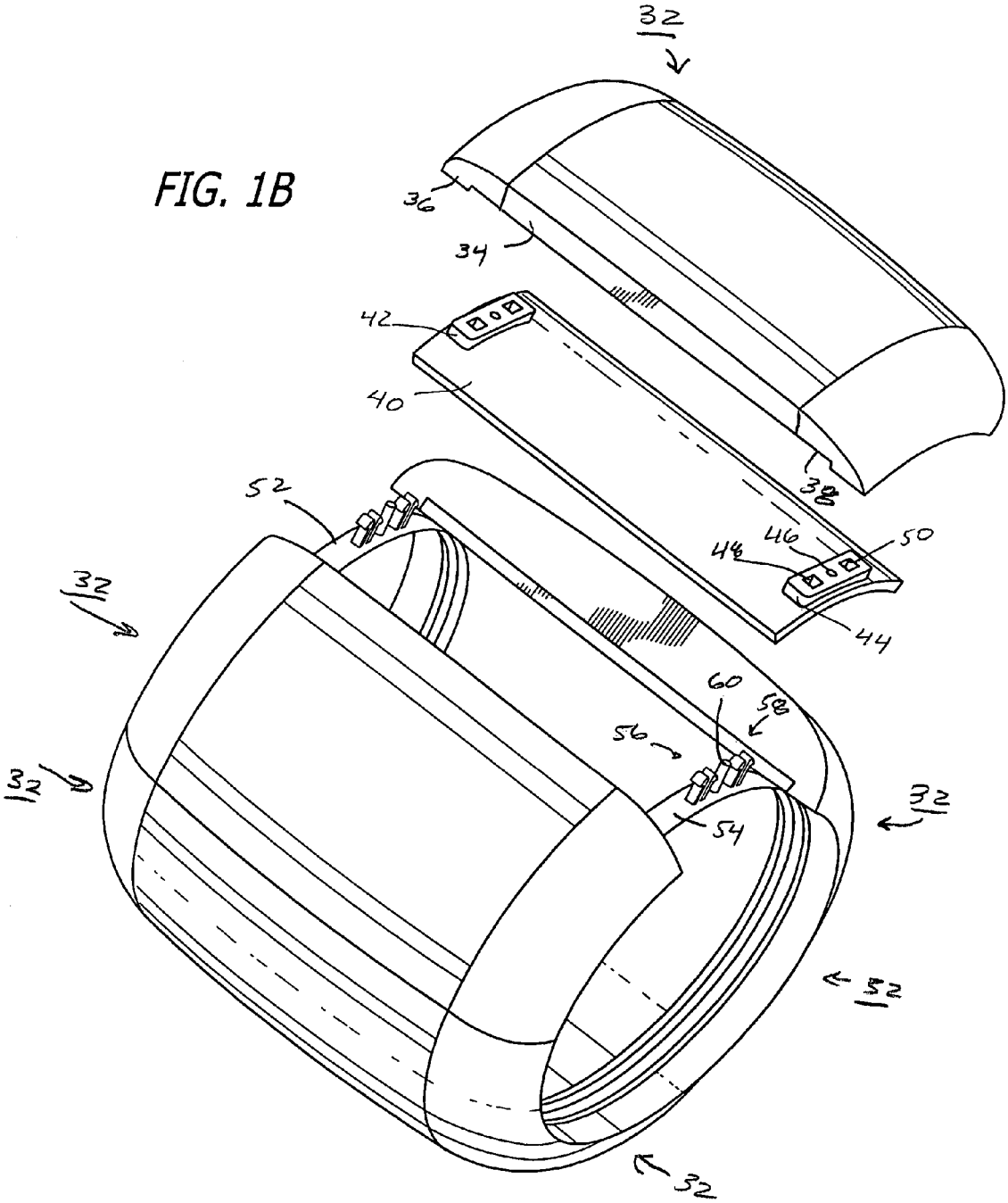

FIGS. 1A and 1B are completed and partially-exploded perspective views respectively of the bowling practice device 10 of the invention. The device 10 comprises a generally-cylindrical hollow body whose shaped is bounded by an outer wall 12 and a cylindrical inner wall 14. The outer wall 12 is joined to the cylindrical inner wall 14 by means of tapered end pieces 16, 18 to complete the generally-cylindrical shape of the hollow body that comprises the bowling practice device 10.

As will be described below, the device 10 includes features that enable a bowler to develop a consistent arm swing or stroke away from the bowling alley. It includes a number of features, including an aerodynamic design and finger holds that contribute to the exercise and evaluation of stroke consistency. The device 10 allows repetition of motions (at home) that result in the development of muscle memory (grooving) in regard to the bowler's personal stroke. Such development of muscle memory is readily transferred to the bowling ball and bowling alley.

Finger holes are provided for emulating the finger holes of a bowling ball. Two sets of finger holes are provided on the device. A first set or pair of rather small and relatively closely-spaced finger holes 20, 22 is provided primarily for children and others who may not require the type of personalized fitting that an experienced bowler (who may have a bowling ball that is fitted to his hand and finger span) may require for optimum benefit. A second pair of finger holes 24, 26 is provided that may be fitted to the hand of the bowler. The detailed structure and operation of the elements associated with the adjustable finger holes 24, 26 is described below with particular reference to FIGS. 4A, 4B and the associated portions of the specification.

Longitudinal stripes 28 are painted or otherwise imprinted upon the outer wall 12 of the device 10. Such stripes enable the bowler to evaluate the correctness of his posture when first addressing the ball (i.e. prior to the backswing). It is during this portion of the stroke that the bowler initially locks his or her wrist and is critical to the success or the entire stroke. By providing visible longitudinal stipes 28 that are parallel to the imaginary line that connects the centers of the finger holes, the bowler is able to observe when he or she has aligned the "ball" precisely correctly during the addressing phase of the stroke.

Additional details of the structure of the device 10 are illustrated by the partially-exploded perspective view of FIG. 1B. As can be seen, the device 10 comprises a collapsible structure for facilitating transport. In this way, one may store it in a suitcase, for example. This permits reassembly for use in a hotel room during a business or other trip.

The outer wall 12 is formed of a plurality of cover sections 32. Each cover section is, in turn, comprised of an intermediate piece 34 joined (by gluing, for example) at its opposed ends to end pieces 36 and 38. Each of the end pieces is aerodynamically tapered to join a bottom board 40 which is, in turn, glued to the bottom of the cover section 32. Each of the cover sections 32 comprises a rugged piece capable of absorbing the shock of collision with a wall when used and is preferably of foam-like composition. Such cover sections 32 are preferably of injection-molded foam rubber, ethylene-vinyl acetate foam or polyethylene foam composition.

The curved inner (bottom) surfaces of the bottom boards, when joined together, form the cylindrical inner wall 14 of the device 10. Pedestals 42, 44 are provided adjacent opposed ends of the bottom board 40 having apertures (a central aperture 46 and outer apertures 48, 50) that serve as female elements for receiving corresponding male members affixed to an assembly ring 52, 54.

The assembly rings 52, 54 provide a frame onto which the elements of the cowl-like device 10 are fixed. Pairs of barbed inserts 56 and 58 interlock with outer apertures 50 of the pedestal to secure the composite of cover panel 32 and bottom board 40 to the assembly ring 54 while a like arrangement secures the opposed end of the composite to the assembly ring 52. Similarly, other segments of the device 10 are engaged and fixed at their opposed ends to the assembly rings 52, 54 by the interactions of like elements (i.e. a pedestal fixed to a bottom board with apertures aligned to lockingly receive pairs of barbed inserts fixed to an underlying segments of the assembly rings 52 and 54).

Additionally, a vertical dowel 60 is fixed to the assembly ring 54 intermediate the pairs of barbed inserts 56 and 58. The dowel 60 is aligned with and received within the central aperture 46 of the pedestal 44. Such member provides additional strength to the structure of the device 10 which may be subjected to significant forces and shock when contacting, e.g. a wall in a room of a house during use.

Figure 2:
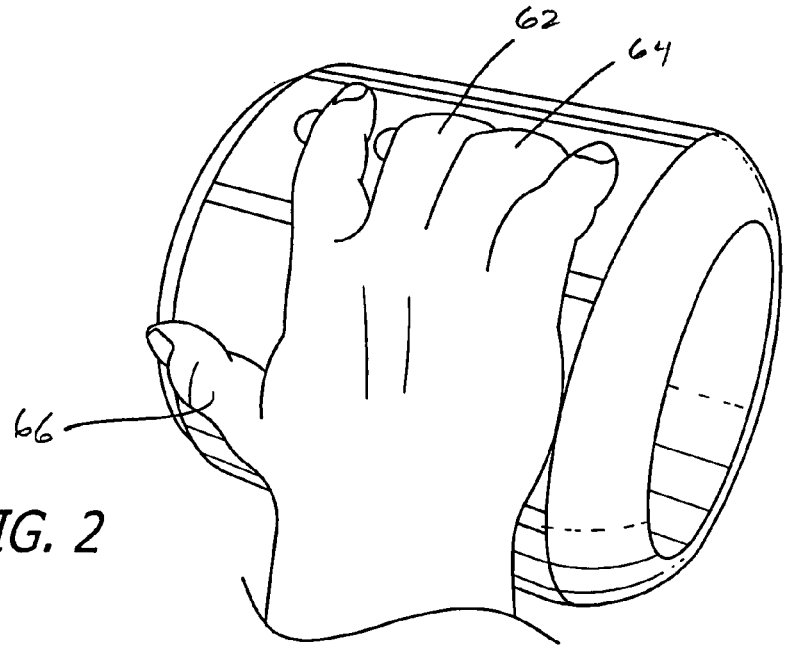
FIG. 2 is a view of the device of the invention as gripped for use.

FIG. 2 is a view of the device of the invention as gripped for use. As can be seen, fingers 62, 64 of the bowler's hand are received in finger holes of the device 10 in like manner and configuration to a bowling ball. The device 10 is preferably about 8.25" in length, 8.25" in diameter and weighs between 3 oz. And 12 oz. to provide aerodynamic performance while giving the user the "feel" of a bowling ball.

While a finger hole is not provided for the bowler's thumb 66, this in no way compromises the effectiveness of the device 10 as a training tool as the role of the thumb 66 is limited to gripping the bowling ball while the fingers 62, 64 impart the spin or rotation to the ball upon release that results in "hooking" or curving of the path of travel the bowling ball.

Figure 3A:
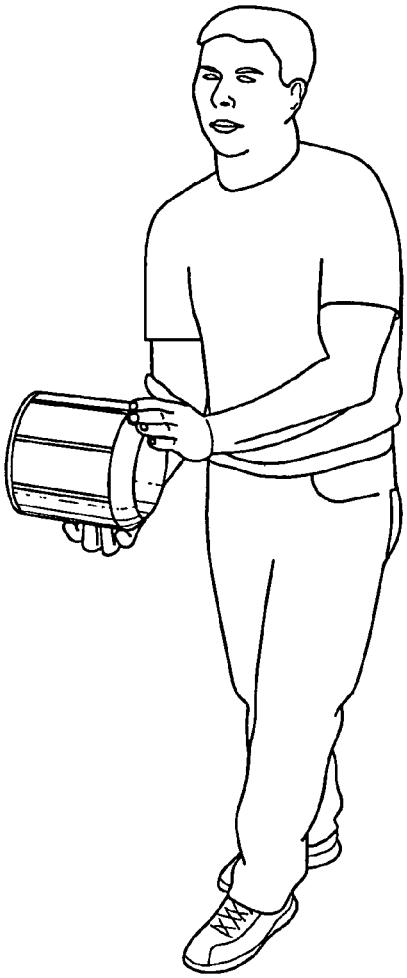
FIGS. 3A and 3B illustrate the invention in use for emulating the address and a portion of the stroke and release of a bowling ball respectively.
Figure 3B:
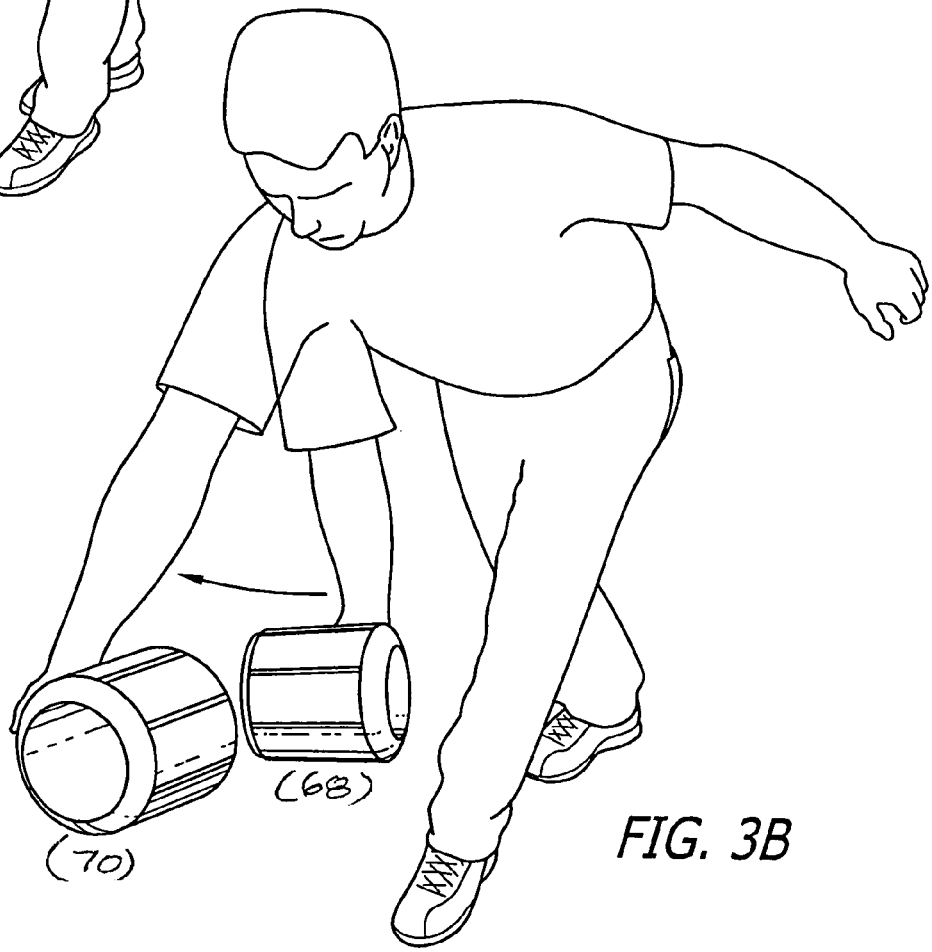

FIGS. 3A and 3B illustrate the invention in use for emulating the address and a portion of the stroke and release of a bowling ball respectively. As discussed above, the longitudinal stripes 28 of the device 10 (aligned parallel with an imaginary line between the centers of the finger holes) enable the user to check for proper wrist alignment prior to the inception of initial stride and backstroke motion by posing as illustrated in FIG. 3A front of a mirror.

The completion of the stroke and release of the device 10 are illustrated in FIG. 3B. As can be seen, proper technique requires a snapping of the wrist (or other action to rotate the palm of one's hand from a horizontal to a vertical attitude) of the bowler as the device 10 (emulating a bowling ball) is released (i.e. as the device is swung between positions 68 and 70.) Unlike practice with a spherical ball, the device 10 enables one to observe the degree of consistency of the stroke itself and without the influence of such factors as lane conditions. Further, its relatively light weight allows the user to release and direct the device 10 at a target. By consistent contacting of the target, the bowler may gain assurance that, through muscle memory, he or she has effectively grooved his or her stroke.

Figure 4B:
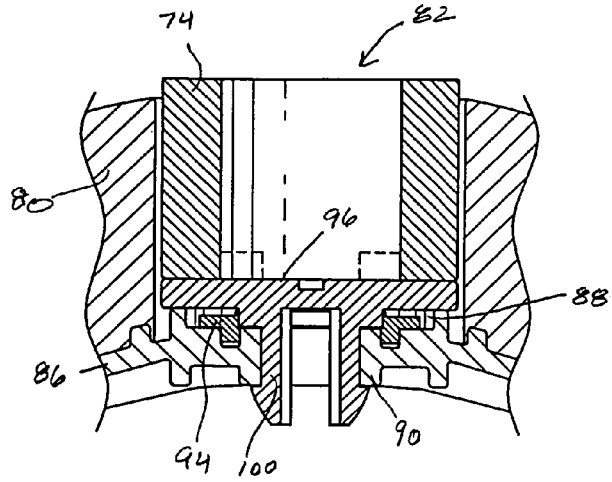
FIGS. 4A and 4B are detailed an exploded perspective and a sectional view taken at line 4B-4B of FIG. 1 for illustrating the arrangement for personalizing the grip of the bowling device of the invention.
Figure 4A:
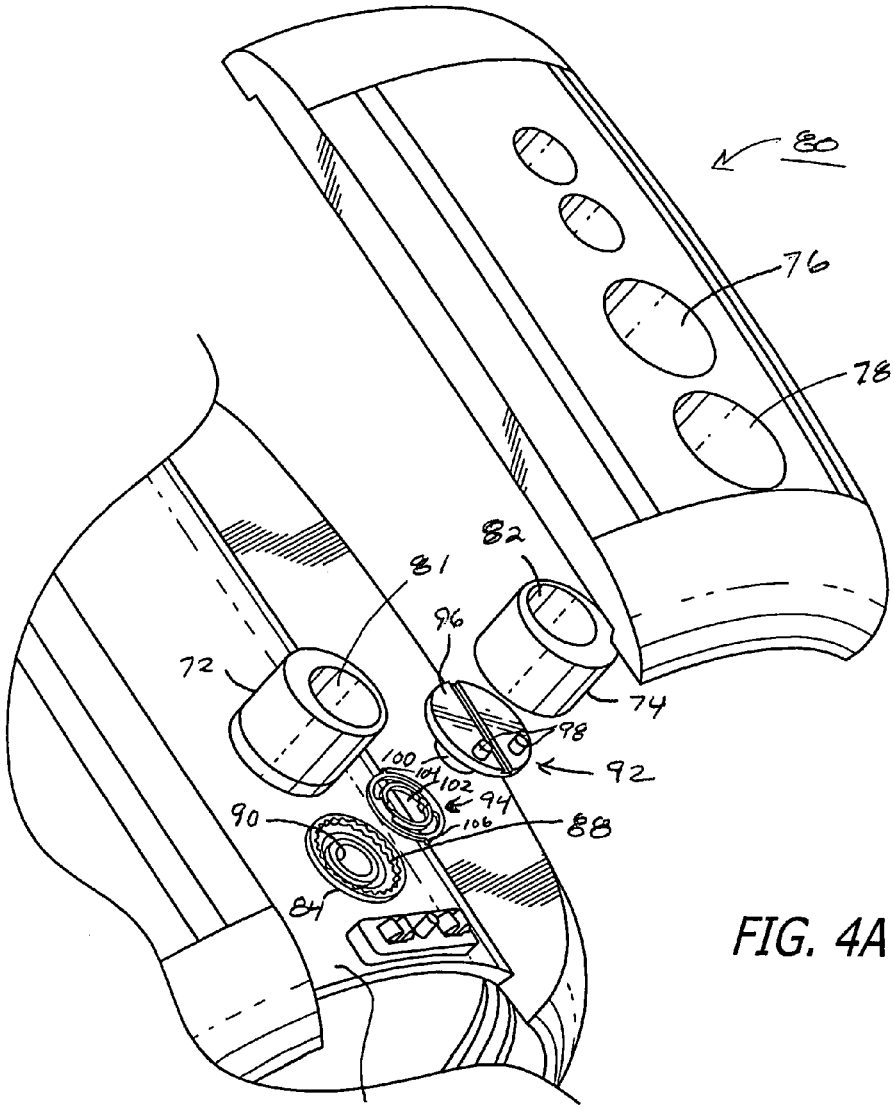

FIGS. 4A and 4B are detailed exploded perspective and sectional views (taken at line 4B-4B of FIG. 1A) for illustrating the arrangement for personalizing the grip of the bowling practice device 10. Personalizing the device 10 to the user's grip (i.e. adjusting the distance between finger holes for the natural spread of the user's hand) will, in many cases, mimic the manner in which the finger holes of the users bowling ball have been drilled to fit his or her hand. In the invention, this is accomplished through selective rotation of finger plugs 72 and 74 that are fitted within apertures 76 and 78 respectively of a cover section 80. Offset interior channels 81, 82 within the finger plugs 72 and 74 respectively provide finger holes for the user.

A receptacle, such as receptacle 84 is formed in the upper surface of the bottom board 86 that underlies the cover panel 80 and is aligned with an overlying finger hole 78. The interior or the receptacle is serrated, having a plurality of inwardly-directed teeth 88 which surround a central aperture 90.

Each finger plug 74 forms part of a three-piece unit (the three pieces being glued together) that includes an underlying finger panel 92 and a finger ring 94. The finger panel 92 includes a split top surface 96, each side of which includes an upstanding dowel 98 for fitting and being glued with a corresponding hole on the bottom of the finger plug 74. An axial, downwardly-directed shaft 100 at the opposed surface of the panel 96 is aligned with, and glued to, a central aperture 102 of the finger ring 94. Radially-directed nipples 104, 106 are aligned and directed outwardly from the periphery of the finger ring 94.

Referring to FIG. 4B, one may see that the bottom of the shaft 100 is barbed. It thereby holds down the finger panel 92, causing the finger panel 92 to exert a downward-acting force against the bottom board 86. Such downward-acting force causes the finger ring 94 (and the opposed nipples 104 and 106 of the ring 94) that is glued to the finger panel 92 to exert a downwardly-acting force that causes the nipples 104, 106 to become locked in position with respect to the inwardly-directed teeth 88 of the receptacle 84. Such locking of the position of the nipples 104, 106 with respect to the teeth 88 of the receptacle 84 serves to lock the angular position of the de-centered vertical channel 82 that passes through the interior of the finger plug 74 as the finger plug 74, the finger panel 92 and the finger ring 94 are glued together to form an integral unit.

The two integral units comprising the finger plugs 72, 74 with de-centered vertical channels 80 and 82 are rotated within the finger holes 76 and 78 respectively so that the radially-directed nipples of the associated finger rings are independently ratcheted through angular positions with respect to the inner-directed teeth of the underlying receptacles of the bottom board 86. When the two plugs 72 and 74 (and associated finger panels and finger rings) have been rotated to such positions that the distances between the de-centered vertical channels define an appropriate spread or distance therebetween (based, of course, upon the user's preference), downward pressure is applied to the tops of the plugs 72 and 74 to cause the barbed end of the shaft at the bottom of each finger panel to protrude through the aperture at the center of the underlying receptacle of the bottom board and thereby become engaged in the manner illustrated in FIG. 4B. Thus, the finger holes are adjusted to the user.

Thus it is seen that the present invention provides a practice device for a bowler. By applying the teachings of the invention, one is able to realize the advantages of sustained practice at home. The device of the invention provides a number of features that permit the bowler to both analyze his technique and to recognize his progress while practicing in front of a mirror, in a hotel room, bedroom or other convenient location.

While the invention has been described with reference to its presently-preferred embodiment, it is not limited thereto. Rather, the invention is limited only insofar as it is defined by the following set of patent claims and includes within its scope all equivalents thereof.

What is claimed is:

1. A bowling practice device for regularizing the stroke of a bowler comprising, in combination:

a) a generally-cylindrical, hollow body;

b) said body comprising an outer wall and a cylindrical inner wall;

c) a first and a second finger plug;

d) said outer wall having a first and a second finger holes for receiving said first and second finger plugs respectively; and e) opposed ends of said outer wall being inwardly tapered to meet said cylindrical inner wall.

2. A bowling practice device as defined in claim 1 further including:

a) a plurality of cover sections;

b) a corresponding plurality of bottom boards, each of said bottom boards being fixed to one of said cover sections; and c) said cover sections and said bottom boards being arranged to form said outer and inner walls respectively.

3. A bowling practice device as defined in claim 2 further including:

a) a pair of rings;

b) said rings being coaxially aligned; and c) each of said bottom boards being engaged to said rings.

4. A bowling practice device as defined in claim 3 further including:

a) each of said rings having a plurality of arrangements of outwardly protruding elements; and b) each of said bottom boards including a pair of arrangements for lockably receiving said outwardly-protruding elements.

5. A bowling practice device as defined in claim 4 wherein each of said arrangements includes at least one aperture aligned with at least one outwardly-protruding element.

6. A bowling practice device as defined in claim 5 wherein a free end of at least one of said outwardly-protruding elements is barbed.

7. A bowling practice device as defined in claim 5 wherein said at least one aperture is formed in a pedestal fixed to an outer surface of a bottom board.

8. A bowling practice device as defined in claim 1 wherein said outer wall includes at least one longitudinal stripe.

9. A bowling practice device as defined in claim 8 wherein said at least one longitudinal stripe is of contrasting appearance with adjacent regions of said outer wall.

10. A bowling practice device as defined in claim 9 wherein said at least one longitudinal stripe is of color that contrasts with adjacent regions of said outer wall.

11. A bowling practice device as defined in claim 2 wherein each of said finger inserts includes a cylindrical finger plug having a de-centered internal channel.

12. A bowling practice device as defined in claim 11 further including:

a) a finger panel fixed to the bottom of said finger plug;

b) a vertical shaft at the bottom of said finger panel; and c) a receptacle aperture in said bottom board aligned with said finger hole for receiving said shaft.

13. A bowling practice device as defined in claim 12 further including:

a) a finger ring fixed to the bottom of said finger panel;

b) said finger ring including at least one radially-directed nipple; and c) said receptacle aperture comprising an interior surface comprising a plurality of inwardly-directed teeth arranged to contact said radially-directed nipple upon rotation of said finger ring.

14. A bowling practice device as defined in claim 12 wherein a free end of said shaft is barbed.

15. A bowling practice device as defined in claim 2 comprising:

a) six cover panels; and b) six bottom boards.

16. A bowling practice device as defined in claim 2 wherein each of said cover panels comprises ethylene-vinyl acetate foam.

17. A bowling practice device as defined in claim 2 wherein each of said cover panels comprises polyethylene foam.

18. A bowling practice device as defined in claim 2 wherein each of said cover panels comprises foam rubber.

* * * * *